United States Patent [19]

Alff et al.

[11] 4,431,320

[45] Feb. 14, 1984

[54] SYSTEM FOR APPLYING INDICIA TO CONTAINER CLOSURE STOCK

[75] Inventors: Lawrence E. Alff, Haddonfield, N.J.; Edward E. Scheswohl, Philadelphia, Pa.

[73] Assignee: Crown Cork & Seal Company, Inc., Philadelphia, Pa.

[21] Appl. No.: 388,910

[22] Filed: Jun. 16, 1982

[51] Int. Cl.[3] ..... B41J 3/40

[52] U.S. Cl. ..... 400/130; 400/134; 101/18; 101/4

[58] Field of Search ..... 101/18, 93.19, 78, 79, 101/80, 81, 82, 72, 83, 4; 400/134, 130

[56] References Cited

U.S. PATENT DOCUMENTS 3,742,845 7/1973 Giani ..... 101/93.19
3,901,143 8/1975 Alexander et al. ..... 101/18
4,136,612 1/1979 Daguise ..... 101/18

FOREIGN PATENT DOCUMENTS 3102418 2/1982 Fed. Rep. of Germany ..... 101/72

*Primary Examiner*—Clifford D. Crowder
*Attorney, Agent, or Firm*—Woodcock, Washburn, Kurtz, Mackiewicz & Norris

[57] ABSTRACT

A system for applying indicia to container closure stock wherein a reciprocating press is programmed to control the odds for the application of a plurality of indicia to be used for promotional material of the game type. The press anvil strokes are detected and counted and the die carrier is moved to a selected die in accordance with the program. Each die of the plurality of dies available is selected a predetermined number of times but the odds are accurately controlled.

11 Claims, 5 Drawing Figures

SYSTEM FOR APPLYING INDICIA TO CONTAINER CLOSURE STOCK

BACKGROUND OF THE INVENTION

The present invention relates in general to the field of containers for the containment of beverages and the like. More particularly, the present invention relates to an apparatus for the manufacture of metal container closures and parts thereof which are provided with promotional material of the game type, in which a player of the game must purchase the product in order to play the game.

In recent years, it has become increasingly popular in promoting the sale of beverages for bottlers and canners to employ promotional indicia on the inside or under surface of bottle caps and metal container closures. It is also known to apply promotional indicia on the undersurface of opening tabs of the retained type such as disclosed in U.S. Pat. No. 3,967,752—Cudzik. While some promotional indicia may be applied to the aforementioned items by means of lithography, the application of promotional indicia to the undersurface of easy opening tabs of the type disclosed in the aforementioned Cudzik patent is preferably done by a metal stamping or embossing operation.

In the promotional techniques now commonly employed by bottlers and canners, promotional indicia located on container closures and easy opening tabs therefor have been utilized for games and contests. The promotional indicia situated upon a container closure or easy opening tab signifies to a consumer that he has won a prize, the value of which falls into one of a group of categories. The monetary value of prizes in each category differs from the value of prizes in the remaining categories. Thus, the particular indicia imprinted upon a consumer's closure or easy opening tab determines not only the category of prize won, but also is value.

As migh be expected, it is particularly important to bottlers and canners that in a given sales campaign the number of prizes awarded in any given category be accurately controlled. Consequently, it is likewise extremely important to a bottler or canner that the distribution of differing types of promotional indicia signifying the various categories of prizes also be accurately controlled. For example, in one promotional contest technique now employed, a single star or cluster of stars imprinted upon a container closure or easy opening tab signifies to a given consumer that a prize in one of a group of categories has been won. Thus, a closure having but a single star may be redeemed for a prize in a first category having a low monetary value. A group of two stars in a cluster, however, may signify that a prize has been won in a second category having a higher value. Three stars signifies a still higher valued prize, and so on. As might be expected, in each group of container closures manufactured and sold the odds of consumers receiving closures having but a single star will be significatly higher than the odds of receiving closures having a cluster of two stars imprinted thereon. The odds of consumers receiving closures having two stars imprinted thereon are greater than the odds of receiving closures with three or more stars, and so on. It is essential to bottlers and canners that these odds be precisely controlled. It also goes without saying that errors occurring in imprinting indicia on such closures or easy opening tabs therefor may be extremely costly to bottlers and canners.

In the past, to insure that such errors did not occur, at least some manufacturers of closures or tabs therefor, where promotional indicia were applied by metal stamping operations, controlled the odds by hand. Thus, the required number of closures bearing indicia signifying prizes in the highest valued categories were made first. Next, the required number of closures having indicia in the lower valued categories were made and subsequently all closures were mixed randomly by hand for sale. The possibilities for error in such a system are great.

It is an object of the present invention to provide an apparatus for producing container closures and/or easy opening tabs therefor which eliminates the aforementioned disadvantages.

Specifically, it is an object of the present invention to provide an apparatus for producing container closures and/or tabs therefor having indicia thereon in a manner wherein the indicia are applied randomly one from another, yet according to a preselected odds distribution.

It is a further object of the present invention to provide such an apparatus in part of a system for applying indicia automatically to container closure stock.

Still further it is an object of the present invention to provide such a system wherein the odds may be precisely and accurately controlled.

SUMMARY OF THE INVENTION

These and other objects of the present invention are achieved by the provision of a novel system for applying indicia to container closure stock which includes a press having a reciprocating anvil which cooperates with a series of dies all mounted upon a die holder. The die holder is selectively movable so as to position a selected one of the dies adjacent the anvil during each stroke thereof. Each of said dies represents a different indicia to be applied to the container closure stock. A sensor is provided for detecting each stroke of the anvil and motive means are provided for locating a selected one of the dies in the requisite position for each stroke. A control means is also provided which is responsive to the sensor for summing the number of strokes of the press and for insuring that the selected die for each stroke is varied from that selected during the previous stroke or group of strokes. In addition, the control means insures that for a given number of strokes of the punch each of the dies is selected a predetermined number of times such that the odds for the application of each of the different indicia over those strokes will be accurately controlled.

In accordance with the preferred embodiment of the present invention, the die holder comprises a wheel having die sets mounted upon the periphery thereof, the wheel being driven by a rotary servo motor connected axially to the wheel.

BRIEF DESCRIPTION OF THE DRAWINGS

The present invention will be more fully understood by reference to the accompanying drawings, in which.

DETAILED DESCRIPTION OF THE PREFERRED EMBODIMENT

Figure 1:
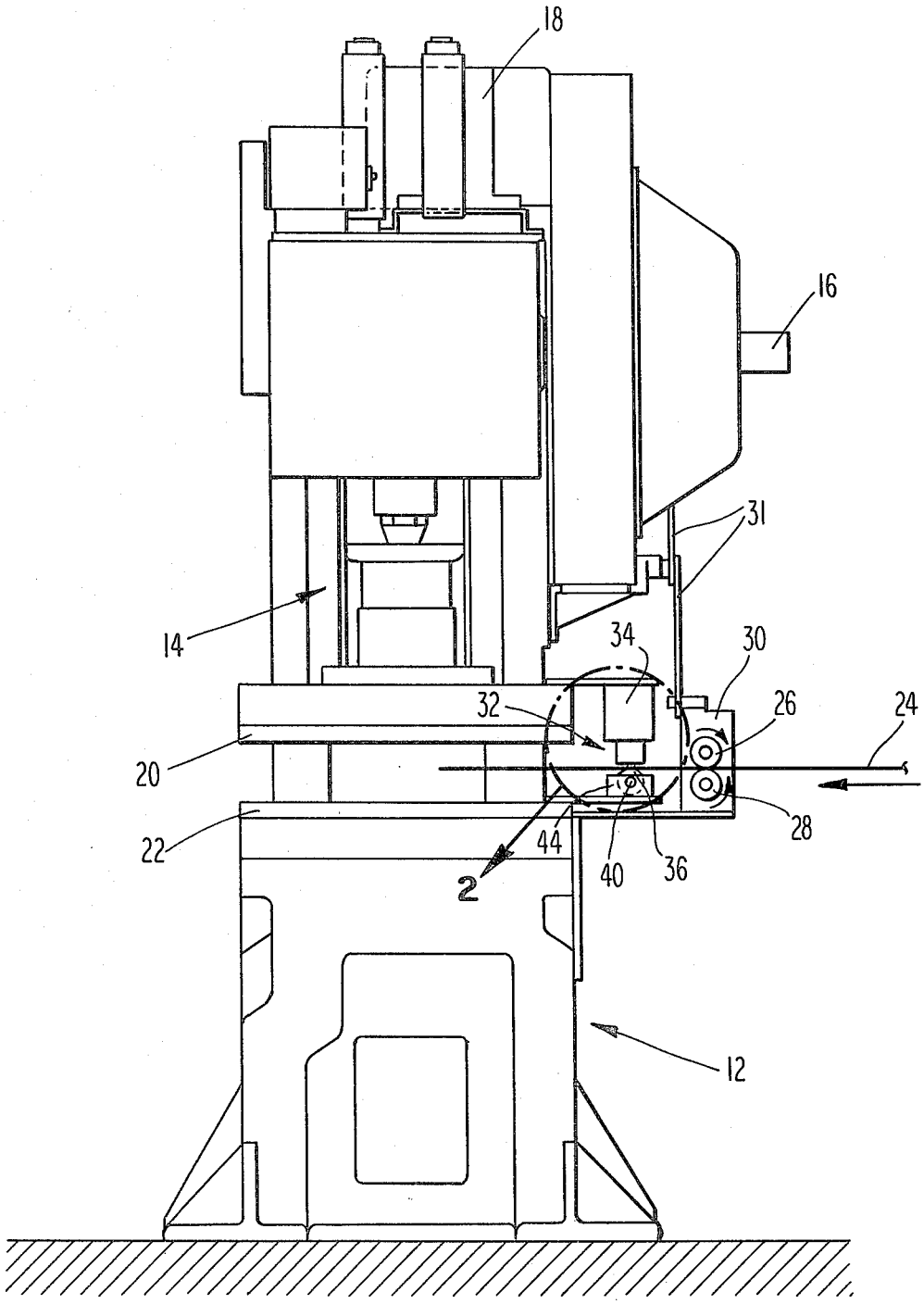
FIG. 1 is a side elevational view of a press illustrating the present invention.

Referring now to FIG. 1, a system for applying promotional indicia to container closure stock may be seen. The system includes a press having a stationary portion 12 and a movable portion 14. The movable portion 14 of the press is adapted to reciprocate vertically with respect to the stationary portion 12. Reciprocation is accomplished by a drive means, not shown, connected to a shaft 16 operating a crank case shown at 18. Reciprocation of the movable portion 14 of the press raises and lowers a jig plate 20 with respect to the bed 22 of the press which is rigidly connected to the stationary portion 12 of the press.

Preferably, the press shown in FIG. 1 is a multistation press having a plurality of work stations each having a reciprocating punch fastened to the jig plate 20 and a die fastened to the bed 22. For the sake of clarity, this series of work stations, including the punches and dies associated with each of those work stations, have not been shown in FIG. 1 other than the first work station 32 with which the present invention is particularly concerned. Container closure stock 24 in strip form is advanced to the various work stations of the press, i.e., between the jig plate 20 and the bed 22, by means of feed rollers 26 and 28 which are driven in opposite rotational directions by means of a gear box 30. The gear box 30 is, in turn, driven by the belts 31 which are linked to the shaft 16.

In accordance with the preferred embodiment of the present invention, the container closure feed stock 24 comprises a metal strip, preferably aluminum. This stock may be appropriately sized such that container closures or can ends may be formed therefrom at the various work stations of the press 10. However, in accordance with the preferred embodiment of the present invention, rather than producing closures from stock 24, the press produces opening tabs therefrom. Thus, preferably, the feed stock is approximately one inch wide and is of the type utilized for the formation of easy opening tabs of the nondetachable type such as are disclosed in the aforementioned U.S. Pat. No. 3,967,752—Cudzik. The various metal working operations needed to convert such a metal strip to a retained or nondetachable type easy opening tab are performed by work stations downstream from the first work station 32. However, before such operations are accomplished and in accordance with the present invention, the metal strip 24 is advanced by the feed rolls 26 and 28 to the first work station 32 which will be described in more detail below in connection with FIGS. 2 through 4. After having left the first work station 32, the metal container closure stock 24 is advanced to the subsequent work stations of the press wherein the stock undergoes the well known subsequent metal forming operations so as to form nondetachable easy opening tabs of the type disclosed in the aforementioned Cudzik patent.

At the first work station 32 promotional indicia are applied. The first work station 32 includes a reciprocating anvil 34. The anvil 34 is connected to the movable jig plate 20. The first work station 32 also includes a movable die holder 36 with the container closure stock 24 being situated between the anvil 34 and the die holder 36.

Figure 2:
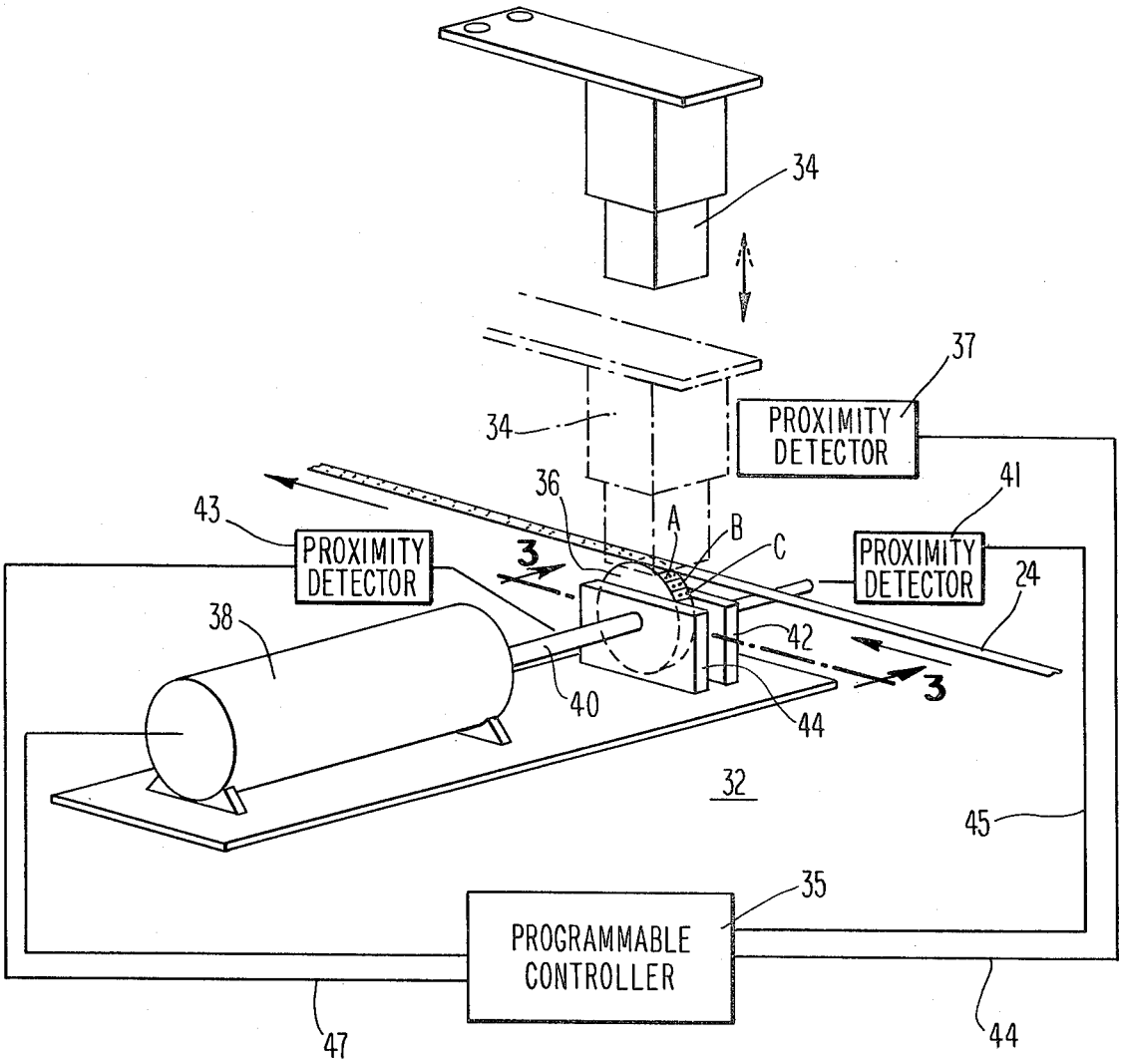
FIG. 2 is a simplified perspective view of the circled region 2 of FIG. 1.

Referring now to FIG. 2, the first work station 32 as well as the remaining elements of the system of the present invention, will be seen in detail. It will be seen that the system of the present invention, in addition to the anvil 34 and the movable die holder 36 also includes a first sensor shown at 37, a motor shown at 38 and a control means shown at 35. As shown in FIG. 2, and in accordance with present invention, the anvil 34 reciprocates from its retracted position shown in full to the advanced position shown in phantom at which time it cooperates with the die holder 36 having a plurality of different dies A, B, C, etc., mounted thereon. Situated between the reciprocating anvil 34 and the die holder 36 is the tab stock 24 upon which promotional indicia is to be applied. The die holder 36, as shown, preferably comprises a rotating wheel, the dies being mounted or situated upon the periphery thereof as will be more fully described in connection with FIGS. 3 and 4 below. The rotating wheel 36 rotates on a shaft 40 and is supported between two aligned brackets 42 and 44. The wheel 36 is driven by the motor 38 for selectively locating a selected one of the dies A, B, or C, etc., at a position in the path of the reciprocating anvil 34 for each stroke of that anvil. This motor preferably comprises a rotary servo motor 38 which is connected to the wheel 36 by the shaft 40. The shaft 40 is linked axially to the wheel 36.

The rotary position of the die holder 36 and thus of the motor 38 is controlled by means of the control means 35 which preferably comprises a programmable controller. The first sensor means 37, preferably comprises a proximity detector, which may be located adjacent the anvil 34. Alternatively, the proximity detector may sense rotation of the shaft 16. In either case the first sensor 37 detects each stroke of the press 14 by ascertaining when the anvil 34 achieves the advanced position shown in phantom. The first sensor 37 is connected to the control means 35 by an electrical connection shown at 44.

Also, in accordance with the present invention second and third sensors 41 and 43 are provided. Sensors 41 and 43 are, like sensor 37, proximity detectors and each are connected to the control means 35 by electrical connections 45 and 47, respectively. The second sensor or proximity detector 41 senses the rotational position of the die holder 36. The third sensor or proximity detector 43 senses the rotational position of the shaft 40. The control means 35 which is responsive to both the second and third sensors 41 and 43, compares the rotational position of the shaft 40 and the die holder 36 to insure that no slippage has occurred between these two components.

In accordance with the present invention, the control means 35 is also responsive to the first sensor 37 and is capable of summing the number of strokes of the anvil 34 such that it may be determined when a given number, N, of strokes have been made. In accordance with a most important aspect of the present invention, the control means 35 is also operative to control the motor 38 and therefore the rotational position of the die holder 36 such that a particular die A, B, C, etc., may be selected for each stroke of the anvil 34 with the die being varied from the die selected for the previous stroke, or the previous group of strokes. However, also in accordance with the present invention, for every N strokes of the anvil 34 each of the plurality of dies A, B, C, etc., is selected a predetermined number of times. In this manner, the odds for the application of all of the different indicia over N strokes may be accurately controlled.

Specifically, where n is the total number of dies positioned about the periphery of the wheel 36 and where i is an integer representing each die of that plurality, the control means 35 is capable of receiving and storing a value for $a_i$. The value $a_i$ may be defined as the predetermined number of times the ith die is to be selected for every N strokes of the press 10. The control means 35 is provided at initialization with values for $a_i$ and N and is thus able to control the odds that each die will be selected for a given number of strokes of the anvil 34. The odds that a particular die will be selected on each stroke may thus be expressed mathematically as $(a_i/N)$. The sum of the odds for the application of all of the indicia over N strokes, may be expressed by the formula $$\sum_{i=1}^{i=n} \frac{a_i}{N} = 1.$$

Figure 2A:
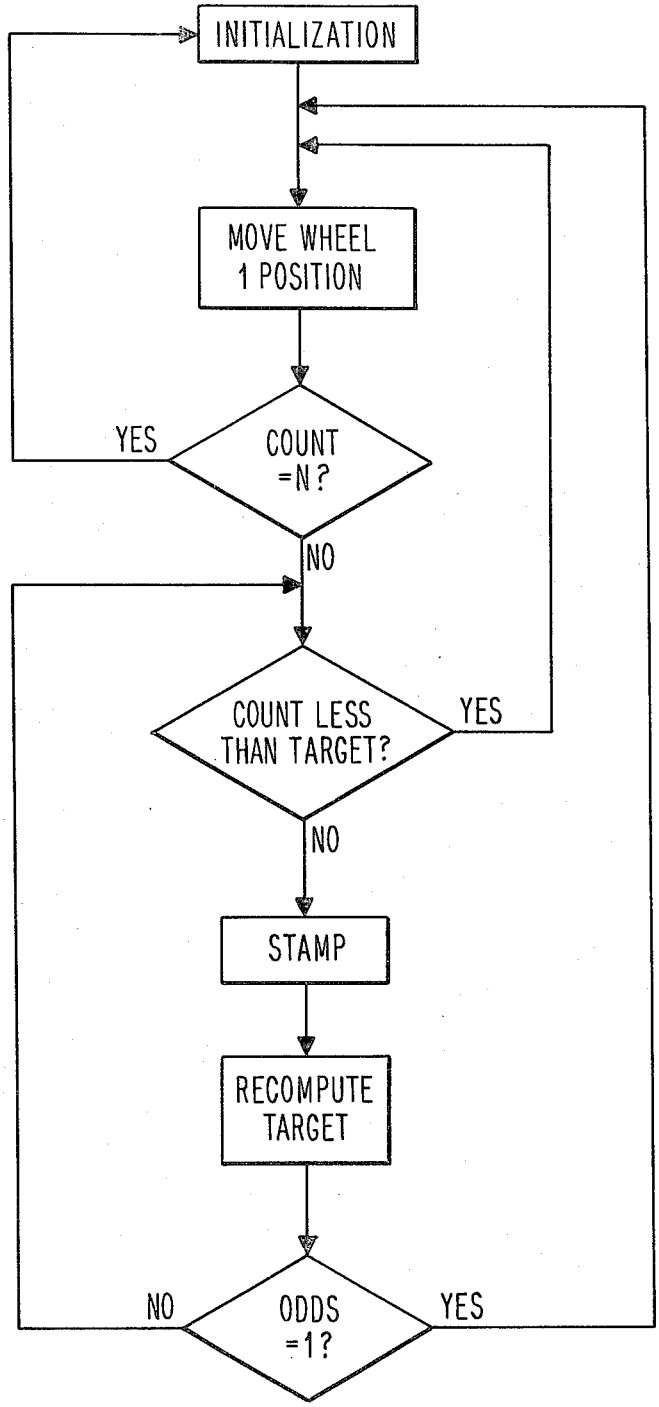
FIG. 2A is a flowchart illustrating the operation of the program controller of FIG. 2.

As mentioned above and in accordance with the present invention, the control means 35 may comprise a programmable controller. Referring now to FIG. 2A, a flowchart illustrating one particular method of programming that controller to accomplish the objectives of the present invention will be seen. As shown in FIG. 2A, the control means 35 is first initialized. At initialization, the control means 35 is provided with the initial rotational position of the die holder 36. It is also provided at this time with a predetermined number (N) of tabs to be made in a given lot and it is further provided with the total number (n) of dies situated about the periphery of the die holder 36. Additionally, at initialization, the control means 35 is provided with the odds $(a_i)$ that the ith die will be selected on a particular stroke. Finally, at initialization the first target positions for each of the end dies are input to the control means 35. By target position is meant, the predetermined stroke of the anvil 34 at which a particular die A, B, C, D, etc., will be selected. In the embodiment shown in FIG. 2A, dies bearing indicia which will signify a winning tab are arbitrarily given target position of 1. Winning dies are provided with an initial target position greater than 1. As shown in FIG. 2A, after initialization, the die holder 36 is moved one position. Next, the current count from the first sensor 37 is monitored by the control means 35. If the current count is equal to the total number (N) of tabs to be made, the system is reinitialized. If the current count is less than the total number (N) of tabs to be made, the current count is compared against the stored target position for the selected die. If the current count is not less than the next stored target position for that selected die, the anvil 34 is reciprocated to "stamp" a tab with the selected promotional indicia and the count is increased by one. The next target position for that selected die is then computed in the block marked "sub-recompute target." The updated target position is defined as the previous target position for the selected die plus the preselected odds $(a_i)$ for that die. So long as the initial target position for that selected die was not equal to 1, the new count is compared against the updated target position. If the next count from the sensor 37 is not less than that updated target position, another tab is stamped. On the other hand, if that next count is greater than or equal to the updated target position, the wheel 36 is advanced one position. The foregoing continues until such time as the total count is equal to the total number (N) of tabs to be made at which time the controller 35 must be reinitialized.

Figure 3:
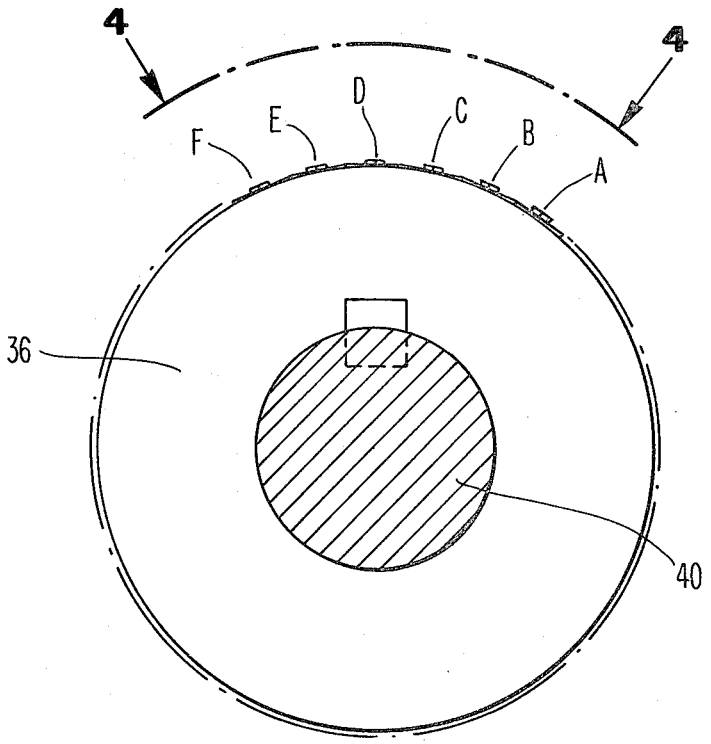
FIG. 3 is a cross-sectional view taken in the direction 3—3 in FIG. 2.

Referring now to FIG. 3, a cross-sectional view of the die holder 36 will be seen. In the embodiment shown in FIG. 3, the total number, n, of dies may be equal to 30, with six dies A, B, C, D, E, F, etc., being shown in the arcuate sector 4—4. Thus, in the embodiment of FIG. 3, each die occupies a 12° sector of the periphery of the wheel 36.

Figure 4:
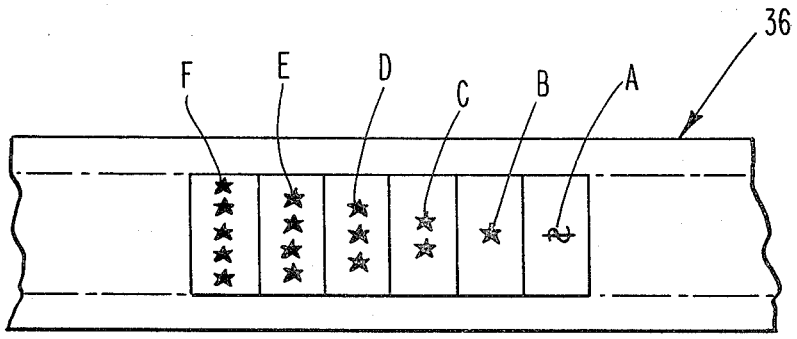
FIG. 4 is a top view of the die holder of FIG. 3 in the direction of section line 4—4 showing some of the dies mounted thereon.

In the merely illustrative embodiment shown in FIG. 4, the die A may be a monetary indicia thus indicating, when applied to closure stock and sold, that a monetary prize has been won, whereas dies B, C, D, E and F may comprise, for example, star clusters having increasing numbers of stars thus indicating that prizes of increasing value have been won depending on the dies B, C, D, E or F which has been selected by the control means 35.

In the above description of the preferred embodiment of the present invention, the control means 35 has been illustrated as controlling the operation of a single press. It should be understood, however, that the control means 35 could control the odds for a plurality of presses operating in tandem.

While the present exemplary embodiment of this invention has been illustrated and described, it will be recognized that this invention may be otherwise variously embodied and practiced within the scope of the following claims.

What is claimed is:

1. A system for applying indicia to container closure stock comprising:

a press having a reciprocating anvil, and a die holder having a plurality of different dies mounted thereon, any of which may be selectively moved to a position in the path of said anvil during each stroke thereof and each of which represents a different indicia;

a sensor for detecting each stroke of said anvil;

motive means for locating a selected one of said dies at said position for each stroke of said anvil;

means, responsive to said sensor means, for counting said strokes and for controlling said motive means such that for each stroke of said anvil the selected die is varied but for every N strokes of said anvil, N being greater than said plurality of dies, each of said plurality of dies is selected a predetermined number of times whereby the odds for the application of all of said indicia over N strokes may be accurately controlled.

2. The system of claim 1 wherein:

n is the total number of said plurality of dies;

i is an integer representing each die of said plurality;

$a_i$ is the predetermined number of times the ith die is selected for every N strokes;

$(a_i/N)$ are the odds that the ith die set will be selected for a particular stroke; and the sum of the odds of the application of all of said indicia over N strokes is $$\sum_{i=1}^{i=n} \frac{a_i}{N} = 1.$$

3. The system of claim 1 wherein said press is a multi-station press and in which said anvil and said die holder comprise a single station.

4. The system of claim 1 wherein said die holder comprises:

a rotating wheel, said dies being mounted on the periphery thereof.

5. The system of claim 4 wherein said motive means comprises a rotary motor axially linked to said wheel.

6. The system of claim 5 wherein said motive means comprises a servo motor.

7. The system of claim 6 wherein said counting and controlling means comprises a programmable controller.

8. The system of claim 7 wherein said sensor comprises:

a proximity detector.

9. The system of claim 1 wherein said container closure stock comprises a metal strip.

10. The system of claim 9 wherein said metal strip is to be formed into a plurality of easy opening tabs.

11. The system of claim 10 wherein said easy opening tabs are of the nondetachable type.

* * * * *